United States Patent [19]

Katz

[11] Patent Number: 4,917,013

[45] Date of Patent: Apr. 17, 1990

[54] MANDREL WITH MULTIPLE LOCKING HEADS

[76] Inventor: Sidney Katz, 6 Hedgerow La., Spring Valley, N.Y. 10977

[21] Appl. No.: 239,181

[22] Filed: Aug. 31, 1988

[51] Int. Cl.[4] ..... B41F 13/10; B41F 27/06

[52] U.S. Cl. ..... 101/375; 29/113.1

[58] Field of Search ..... 101/375, 376; 279/2 A; 29/113.1

[56] References Cited

U.S. PATENT DOCUMENTS

| | | | |
|---|---|---|---|
| 2,289,453 | 7/1942 | Randall | 29/113.1 X |
| 4,383,483 | 5/1983 | Moss | 101/375 |
| 4,386,566 | 6/1983 | Moss | 101/375 |
| 4,407,199 | 10/1983 | Moss | 101/375 |

FOREIGN PATENT DOCUMENTS

| | | | |
|---|---|---|---|
| 1297413 | 6/1969 | Fed. Rep. of Germany | 29/113.1 |

*Primary Examiner*—Clifford D. Crowder

*Attorney, Agent, or Firm*—Abelman Frayne Rezac & Schwab

[57] ABSTRACT

A mandrel for supporting printing sleeves and the like comprising a hollow cylinder with a multiplicity of expansion chambers axially spaced along the cylinder at its outer surface. Each chamber is closed by an expansion sleeve and connected to a separately controlled hydraulic line allowing each sleeve to be expanded independently of the others.

1 Claim, 1 Drawing Sheet

MANDREL WITH MULTIPLE LOCKING HEADS

FIELD OF THE INVENTION

This invention relates to a mandrel for use in the support and rotation of printing sleeves, as used in rotary printing presses.

BACKGROUND OF THE INVENTION

The use of mandrels having radially expandable expansion heads is taught in Katz et al., U.S. Pat. No. 4,651,643, and in Katz, U.S. Pat. No. 4,381,709, these patents relating to mandrels for use in the support of a single printing sleeve in a rotary printing press. These constructions of mandrel have received wide acceptance in the printing industry in maximizing productivity by their ability to quickly accommodate any one of a number of different printing sleeves with an absolute minimum of down time of the printing press.

Rotary printing presses are demanding of extremely high accuracy, and thus, are costly. This requires that production of the printing presses be maximized to the greatest possible extent for the printing presses to be economically viable. Commonly, such printing presses can accommodate printing cylinders of 36 inches or more, this in turn requiring that the entire surface of the printing cyclinder be available for printing if maximum productivity is to be realized. While this is cost-effective for large volume production runs, it severely reduces the cost effectiveness for smaller production runs, and it limits a production run to the actual printing plates available on the printing cylinder, with no opportunity of replacing selected ones of the printing plates by different printing plates.

SUMMARY OF THE INVENTION

It is an object of this invention to increase the cost effectiveness of rotary printing presses, such as flexographic or gravure presses, by providing a mandrel assembly that will accommodate a plurality or a multiplicity of axially short printing sleeves or die cutting sleeves that can be assembled onto a single mandrel, thus permitting multiple production runs to be accomplished during a single production run of the printing press.

This is accomplished by providing a mandrel having multiple expansion rings spaced axially along the length thereof and which are simultaneously or selectively actuable in order to secure a plurality or multiplicity of axially short printing or die cutting sleeves on the mandrel for simultaneous use during a printing run of the printing press.

For example, a single mandrel of 36 inches length can accept two 18 inch length printing sleeves, or four 9 inch length printing sleeves, or six 6 inch length printing sleeves, etc., each printing sleeve being related to a different production run to that of each other printing sleeve.

The number of, and axial width of the expansion sleeves provided on the mandrel, and the axial spacing thereof, will determine the versatility of the mandrel in accepting printing sleeves of different axial lengths, it being contemplated that almost the entire axial length of the mandrel can be comprised of closely spaced expansion sleeves, or that expansion sleeves arranged at different axial spacings can be provided on the surface of the mandrel.

Also, the respective expansion sleeves can be made relatively narrow for them respectively to engage with and secure the end of a single printing sleeve, or they can be relatively wide for them to bridge and secure adjacent ends of a pair of printing sleeves.

As is known in the art, the expansion sleeves are expanded radially outwardly by hydraulic pressure exerted on the radially inner faces of ring-shaped diaphragms of the sleeves. According to the present invention, either a single hydraulic pump can be provided, common to each of the expansion sleeves, or hydraulic pumps can be provided common to selected pairs of the expansion sleeves, or a separate hydraulic pump can be provided for each and every one of the expansion sleeves.

BRIEF DESCRIPTION OF THE DRAWINGS

Preferred embodiments of the invention will not be described with reference to the accompanying drawings, in which.

DESCRIPTION OF THE PREFERRED EMBODIMENT

Figure 1:
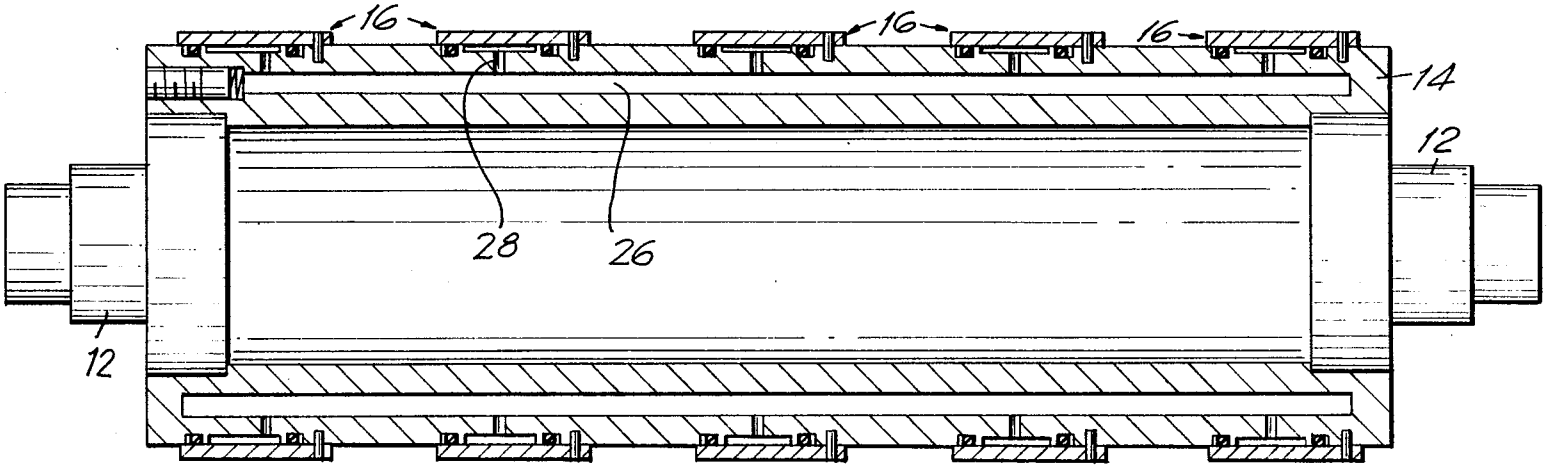
FIG. 1 is a longitudinal cross section through a typical multiple ring mandrel according to the present invention.

Referring to FIG. 1, the mandrel of the present invention includes end journals 12 which are positioned within and secured to a hollow cylinder 14. The journals are each formed from a highly wear resistant material, such as steel, and the cylinder also can be formed from steel, or preferably is formed from a lightweight material, such as an aluminum alloy.

Figure 2:
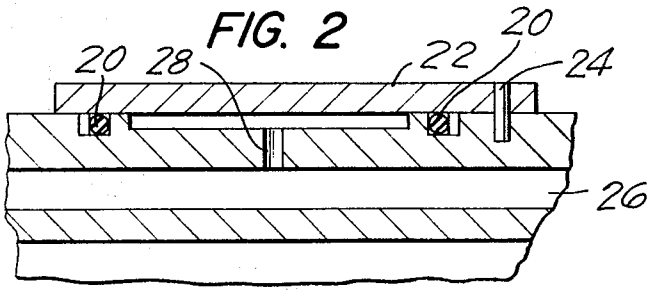
FIG. 2 is a view to a larger scale of one of the expansion sleeves of the mandrel of FIG. 1.

Positioned axially of the cylinder 14 at any desired spacing are expansion sleeves indicated generally at 16, and which are shown in greater detail in FIG. 2.

Each expansion sleeve is comprised of a channel 18 formed in the outer periphery of the cylinder 14, and which is flanked on each of its sides by an O-ring containing groove 20. A resiliently flexible expansion diaphragm 22 bridges the O-rings 20 and is pinned to the outer surface of the cylinder at 24.

Each channel 18 communicates with a supply conduit 26 for hydraulic fluid under pressure through radially extending ports 28. Thus, when the channel 18 is sufficiently pressurized, the diaphragm 22 is expanded radially outwardly into gripping and securing engagement with a printing sleeve (not shown) or the adjacent ends of a pair of printing sleeves which have been positioned over the expansion ring.

As shown in FIG. 1, a single hydraulic pump 30 is provided for simultaneously pressurizing all of the expansion sleeves. As is well known in the art, the hydraulic pump can be of the screw-operated plunger type, which when threaded inwardly of its threaded board, will generate considerable hydraulic pressure within the supply conduit 26, and thus in the channels 18, in order to cause the required outward radial expansion of each of the expansion sleeves.

Figure 3:
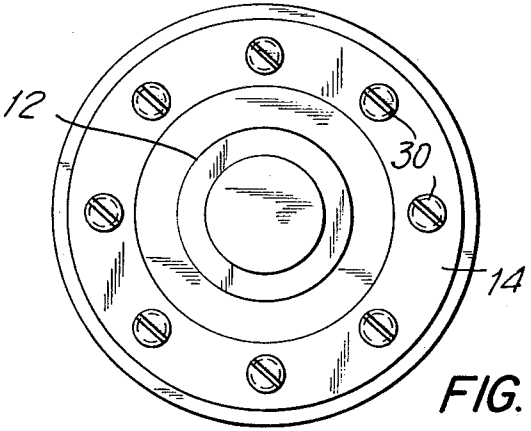
FIG. 3 is an end view of an alternative form of the mandrel of FIG. 1.

Alternatively, and as shown in FIG. 3, a separate hydraulic pump 30 can be provided for each expansion sleeve, the respective hydraulic pumps 30 being arranged in an angularly spaced array about the axis of the cylinder 14, and each communicating with a supply conduit 26 and a selected one of the expansion sleeves 16.

As will be appreciated, the mandrel of the present invention, as illustrated, can accommodate any combination of 9 inch, 18 inch and 27 inch printing sleeves or a 36 inch printing sleeve for a 36 inch axial length of the mandrel. Closer spacing of the expansion sleeves 16 and an increase in their total number will further increase the versatility of the mandrel in accepting a greater number of printing sleeves of smaller axial lengths, such as printing sleeves having an axial length of 6 inches or less. Also, any combination of printing sleeves or die cutting sleeves can be accommodated on the mandrel.

The advantages of the present invention are manifest and will be readily apparent to persons knowledgeable in the art. Two or more printings can be accomplished in a single production run of the press, whether it be a long run or a short run, with interchangeability of the printing runs to accommodate specific needs, and without the necessity of preparing a single printing cylinder common to all of the selected printings. Also, "rough" printing and "process" printing, and also die cutting can be effected during the same production run, merely by selecting printing or die-cutting sleeves appropriate to that production run.

A further and major advantage of the invention is that an Anilox roller no longer has to be constructed as an integral roller. Anilox rolls are costly and used to deposit the correct amount of ink to the flexographic printing cylinder for a particular printing job.

The practice is to coat the surface of the Anilox roll with chrome or ceramic. These surfaces are engraved with various line count volume combinations and cell configurations. If these engraved surfaces are damaged, the expensive roll would have to be discarded. For another printing job, another line count, volume and cell configuration would be needed. With this invention the damaged Anilox roll or a new surface configuration could be replaced with an inexpensive sleeve on the mandrel, rather than the very expensive integral anilox roller. Similarly, the embossing roller design can be changed to a sleeve design for another printing job. Once the required printing run has been effected and no subsequent printings are required, then, the printing cylinder itself must be discarded in that it is difficult or impossible to remove the ceramic overlay, or to satisfactorily recoat the cylinder with a ceramic overlay preparatory to a subsequent laser etching process.

By use of the present invention, only relatively inexpensive printing sleeves are required, which can be coated and etched as required, and if of no further use, or if damaged, can then be discarded at relatively minor expense. If of no further use, the sleeves can easily be stored for repeat use at a later time.

Similarly, expensive die cutting cylinders, which are disposable after having served their intended purpose, can be in the form of relatively inexpensive and disposable die cutting sleeves of far less cost than that of integral die cutting cylinders, and which subsequently can be discarded at relatively minor expense, or stored for further use.

Various modifications can be made within the teachings of the present invention, such as will readily suggest themselves to persons knowledgable in the art, and depending on the particular applications intended for the mandrel. For example, instead of being formed hollow as illustrated, the printing cylinder 14 could be formed of solid cross section or provided with internal reinforcements, and if the intended use warrants it, the cylinder 14 also could be formed from a high strength material such as steel. Also, various manners of securement of the expandable diaphragms 22 can be utilized, such as by welding, brazing, or soldering of the diaphragms directly to the outer surface of the cylinder 14 at their edges, without in any way departing from the scope of the present invention as defined in the appended claims.

I claim:

1. A mandrel for use in the support of printing sleeves, die cutting sleeves, embossing sleeves and the like, comprising:

a hollow cylinder having a circumferentially extending wall;

a multiplicity of expansion chambers formed in an outer peripheral surface of said cylinder and extending circumferentially thereof at locations spaced axially of said cylinder;

a corresponding multiplicity of expansion sleeves mounted on said cylinder and respectively providing a hermetic closure for a said expansion chamber;

a corresponding multiplicity of hydraulic conduits formed internally of said wall of said cylinder and respectively communicating with a said expansion chamber, said conduits extending axially within said cylinder wall and terminating at an axial end of said cylinder; and, a complimentary multiplicity of pneumatic actuators respectively associated with a said hydraulic conduit;

whereby any selected one of said expansion chambers can be pressurized independently of each other said expansion chamber from an axial end of said cylinder in the presence of at least one sleeve positioned on the outer surface of said cylinder.

* * * * *